United States Patent [19]

Malta

[11] 4,062,317

[45] Dec. 13, 1977

[54] HANDBELL

[75] Inventor: Jacob H. Malta, Doylestown, Pa.

[73] Assignee: Schulmerich Carillons, Inc., Sellersville, Pa.

[21] Appl. No.: 665,897

[22] Filed: Mar. 11, 1976

[51] Int. Cl.[2] ..... G10K 1/06; G10K 1/36

[52] U.S. Cl. ..... 116/171

[58] Field of Search ..... 116/171, 155, 157; 84/406, 47

[56] References Cited

U.S. PATENT DOCUMENTS

| | | | |
|---|---|---|---|
| 3,084,588 | 4/1963 | Landon | 84/407 |
| 3,207,124 | 9/1965 | Malta | 116/171 |
| 3,253,574 | 5/1966 | Malta | 116/171 |
| 3,941,082 | 3/1976 | Malta | 116/171 |

*Primary Examiner*—Daniel M. Yasich

*Attorney, Agent, or Firm*—Woodcock, Washburn, Kurtz & Mackiewicz

[57] ABSTRACT

A handbell comprises a bell having a clapper bar pivotally mounted to a member which is attached within the bell by means extending through a handle secured to the bell. A clapper is attached to the clapper bar and elastomeric means is mounted on the clapper bar to restrain movement of the clapper bar with respect to the member.

5 Claims, 4 Drawing Figures

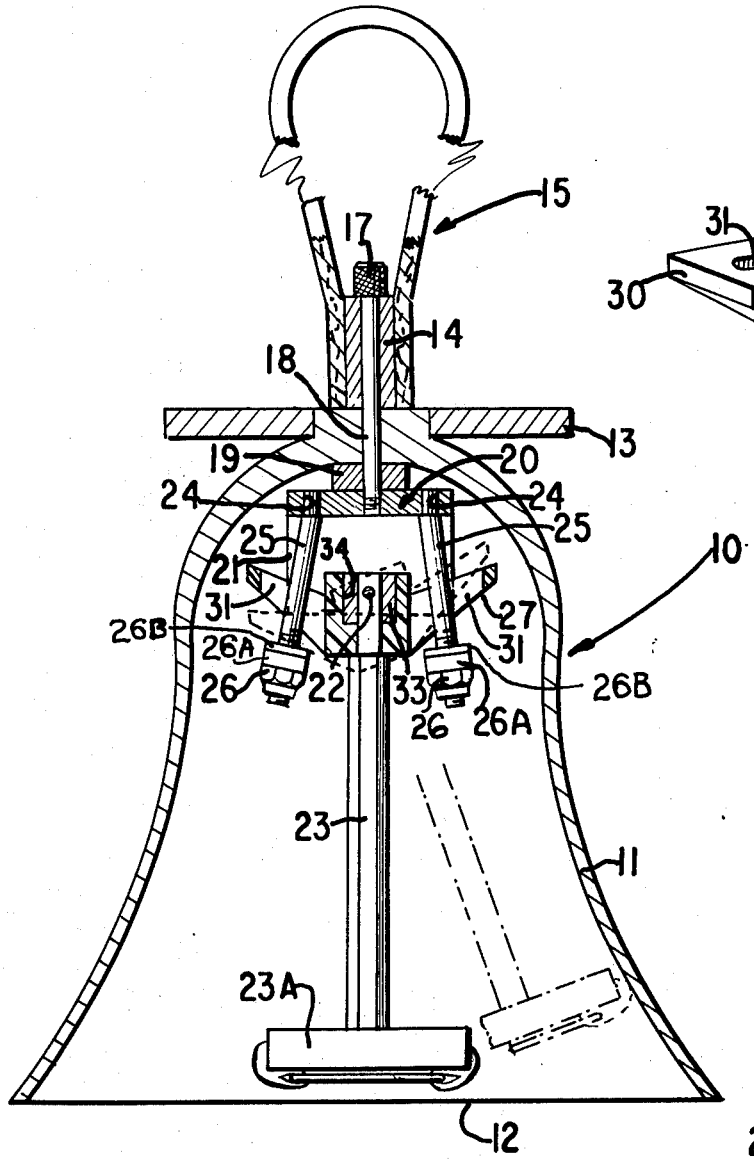
FIG. 1
FIG. 2
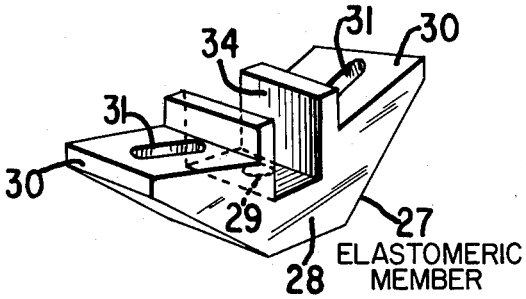
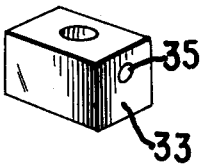
FIG. 3
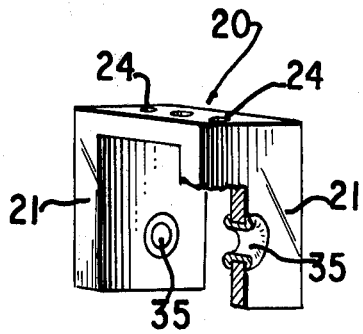
FIG. 4

HANDBELL

The present invention relates to a handbell and, more particularly, to restraining and controlling movement of the clapper within the bell.

Handbells to which the present invention relates are used in manually playing music by groups of players. The music is normally produced by handbells of different sizes that play different notes when the handbells are swung. The group of players may comprise a choir and each of the persons swings different sized bells. Each player swings a bell to produce the ringing sound selectively as the music being played requires. Examples of handbells are shown in U.S. Pat. Nos. 3,139,855; 3,253,574; and 3,207,124.

The principal object of the present invention is to provide a handbell having an improved structure for controlling movement of the clapper within the bell.

Another object of the invention is to provide a handbell having a micrometrically adjustable strike control to permit selection of the desired clapper restraining action to suit the touch or feel of an individual bell ringer.

Another object of the invention is to provide a handbell utilizing elastomeric means to restrain and control the swing of the clapper in both directions.

According to one aspect of the present invention, there may be provided a handbell having a member attached within the bell and a clapper bar pivoted to the member. A clapper is attached to the clapper bar and elastomeric means is mounted on the clapper bar to restrain movement of the clapper bar with respect to said member.

According to a further aspect of the invention, the elastomeric means may comprise a rocker arm mounted on the clapper bar and engageable with micrometrically adjustable means on the member.

Other objects, advantages and features of the present invention will become apparent from the following specification and accompanying drawings which are merely exemplary.

In the drawings:

FIG. 1 is a sectional elevational view of a handbell incorporating the present invention;

FIG. 2 is a perspective enlarged view of an elastomeric device utilized in the handbell of FIG. 1;

FIG. 3 is a perspective view of the block carried in the elastomeric member of FIG. 1; and FIG. 4 is a perspective broken view of the yoke used in FIG. 1.

Proceeding next to the drawings wherein like reference symbols indicate the same parts throughout the various views, a specific embodiment and modifications of the present invention will be described in detail.

Referring particularly to FIG. 1, a handbell according to the present invention is indicated generally at 10 and comprises a cast bell 11 of usual and conventional construction having a mouth 12. A plastic handle disc 13 forms a hand guard to provide protection to the bell surface. A metal block 14 may be attached to flexible hand grip 15 by suitable fastening means such as a plurality of rivets (not shown). The handle or grip 15 may be made of a durable, molded synthetic material, such as polypropelene plastic or the like.

A cap screw 17 can extend through handle block 14, the top of the bell 11, and isolating washer 19, as shown at 18, the cap screw being threaded into a yoke 20. Cap screw 17 permits easy disassembly of all components of the bell for inspection and replacement.

The yoke 20 is shown in greater detail in FIG. 4 and may comprise a pair of parallel spaced legs 21 through which a pin 22 may extend. A clapper bar 23 has one of its ends journalled on pin 22 and the opposite end of the clapper bar may be provided with a clapper 23A.

Yoke 20 has apertures 24 which carry micrometrically threaded screws 25. On the ends of the screws 25 are adjustable stop nuts 26. An elastomeric bumper 26A and washer 26B can be carried above the stop nut.

Mounted on the upper end of the clapper bar 23 is an elastomeric member or device 27, shown in greater detail in FIG. 2, which comprises a body portion 28 (FIG. 2) having an opening 29 therethrough for receiving the upper end of the clapper bar and a pair of angularly extending lateral arms 30, each of which is provided with a slot 31 therethrough. The body portion 28 of the elastomeric member has a substantially U-shaped cross section as can be seen in FIG. 2. The elastomeric member 27 is in the shape of a rocker arm, and its angular arms 30 are positioned to engage the stop nuts 26 on the ends of the micrometric screws 25 which screws pass through the slots 31 of the elastomeric member.

By adjustment of the stop nuts 26, the swinging movement of the clapper bar in both directions can be precisely restrained and controlled to regulate the impact of the clapper on the bell 11. In FIG. 1, the clapper 23A is shown in solid lines in its normal or resting position. The dashed lines show the position of the clapper when it is striking the inner surface of the bell and the position of one arm of the elastomeric member 27 engaging the upper surface of the stop nut 26 or bumper and washer assembly including 26A and 26B to control the pivoting movement of the clapper in the direction as illustrated in FIG. 1. Upward or downward adjustment of either or both stop nuts 26 will thus provide minute control of the clapper position with respect to the restraining action applied to the clapper bar.

The elastomeric member may be of any suitable material having the necessary flexible characteristics, such as polyurethane.

The clapper may be of the adjustable type as disclosed in U.S. Pat. No. 3,253,574.

Block 33 is inserted into saddle 34 of the elastomeric member 27. Block 33 has an aperture 35 through which pin 22 passes.

It will be understood that variations can be made in the invention without departing from the spirit of the invention except as defined in the appended claims.

What is claimed is:

1. In a handbell, the combination including a bell, a handle attached to said bell, a member extending through said handle and bell, a clapper bar, yoke means attached to said extending member, for carrying said clapper bar within said bell, the clapper bar pivoted to said yoke means, a clapper attached to said clapper bar, and an elastomeric device secured to said yoke means and mounted on said clapper bar, said elastomeric device having means to restrain movement of said clapper bar relative to said bell.

2. A handbell as claimed in claim 1 and including micrometrically adjustable apparatus mounted on said yoke means for further restraining movement of said clapper bar.

3. A handbell as claimed in claim 2 wherein said elastomeric device has apertures therein through which micrometric screws of said micrometrically adjustable apparatus passes.

4. A handbell as claimed in claim 1, wherein said elastomeric device is made of polyurethane.

5. A handbell as claimed in claim 2, wherein said elastomeric device restrain movement means comprises a pair of extending lateral arms with flat surfaces, said flat surfaces being positioned relative to said micrometrically adjustable apparatus for contacting same to provide restraining force limiting the movement of said clapper bar.

* * * * *